US005081901A

United States Patent [19]

Kemeny et al.

[11] Patent Number: 5,081,901

[45] Date of Patent: Jan. 21, 1992

[54] ELECTROMAGNETIC LAUNCHER WITH MUZZLE VELOCITY ADJUSTMENT

[75] Inventors: George A. Kemeny, Wilkins Township, Allegheny County; Daniel W. Deis, Churchill Boro, both of Pa.

[73] Assignee: Westinghouse Electric Corp., Pittsburth, Pa.

[21] Appl. No.: 67,561

[22] Filed: Jun. 29, 1987

[51] Int. Cl.[5] ..... F41B 6/00

[52] U.S. Cl. ..... 89/8; 124/3; 318/135

[58] Field of Search ..... 89/8; 124/3; 310/12; 318/135

[56] References Cited

U.S. PATENT DOCUMENTS

| | | | |
|---|---|---|---|
| 3,431,816 | 3/1969 | Dale | 89/8 |
| 3,807,274 | 4/1974 | Cohen | 89/8 |
| 4,319,168 | 3/1982 | Kemeny | 318/135 |
| 4,343,223 | 8/1982 | Hawke et al. | 89/8 |
| 4,386,578 | 6/1983 | Haslund | 219/6.5 |
| 4,714,003 | 12/1987 | Kemeny | 89/8 |

FOREIGN PATENT DOCUMENTS

| | | | |
|---|---|---|---|
| 2125527 | 3/1984 | United Kingdom | 89/8 |

OTHER PUBLICATIONS

Kim et al., "Application of Railgun Principle to High--Velocity Hydrogen Pellet Injection for Magnetic Fusion Reactor Refueling", Fusion Technology, vol. 6, Sep. 1984, pp. 372-377.

*Primary Examiner*—Stephen C. Bentley
*Attorney, Agent, or Firm*—D. Schron

[57] ABSTRACT

An artillery piece which has a gun barrel made up of a parallel rail electromagnetic launcher bore. Current from a source is injected into the rails to propel a bridging armature and projectile. The velocity of the porjectile is measured as it traverses a certain position within the barrel and the measured velocity is compared with a predetermined desired velocity. The velocity of the projectile is modified (if required) toward the muzzle end of the rails as a result of the comparison.

5 Claims, 7 Drawing Sheets

ELECTROMAGNETIC LAUNCHER WITH MUZZLE VELOCITY ADJUSTMENT

BACKGROUND OF THE INVENTION

1. Field of the Invention

The invention in general relates to electromagnetic launcher systems, and particularly to a system which may be utilized as an artillery piece.

2. Description of the Prior Art

An electromagnetic launcher basically consists of a power supply and two generally parallel electrically conducting rails between which is positioned an electrically conducting armature. Current from the power supply flows down one rail, through the armature and back along the other rail whereby a force is exerted on the armature to accelerate it, and a payload, so as to attain a desired muzzle or exit velocity.

The principles of the electromagnetic launcher may be incorporated into an artillery piece for launching relatively heavy projectiles to a distant target. During operation, the exit velocity of one projectile might differ slightly from that of another projectile due to, for example, unequal friction encountered during travel in the launcher or, imperfect firing switch performance, or main power supply deviations, to name a few. Since the projectiles are all of the same standard weight, a very slight difference in the exit or muzzle velocity of the projectile can mean a difference of many hundreds of meters with respect to their impact relative to a target. Accordingly, a need exists for an electromagnetic launcher artillery piece wherein the velocity of the projectile can be more precisely adjusted during the in-bore projectile acceleration.

SUMMARY OF THE INVENTION

An electromagnetic projectile launcher of the present invention includes a pair of generally parallel conducting rail members having a breech end and a muzzle end. A switch means connected to the breech end of the rails is operable to inject current from a high current source into the rails and into a conductive armature between the rails which propels the projectile along the rails.

Velocity measuring means is operable to obtain an indication of projectile velocity at a certain position between the breech and muzzle ends of the rails and means are provided for comparing this velocity indication with a predetermined desired projectile velocity. A rail current or projectile accelerating force modification means is responsive to the velocity indication comparison to modify the velocity of the projectile at which it exits the muzzle end of the rails. When the rails are constructed as part of an artillery piece, information relative to a distant target may be provided to the means for comparing so as to generate the predetermined desired projectile velocity so that projectile exit velocity is accurately controlled for target impaction.

DESCRIPTION OF THE PREFERRED EMBODIMENTS

Figure 1:
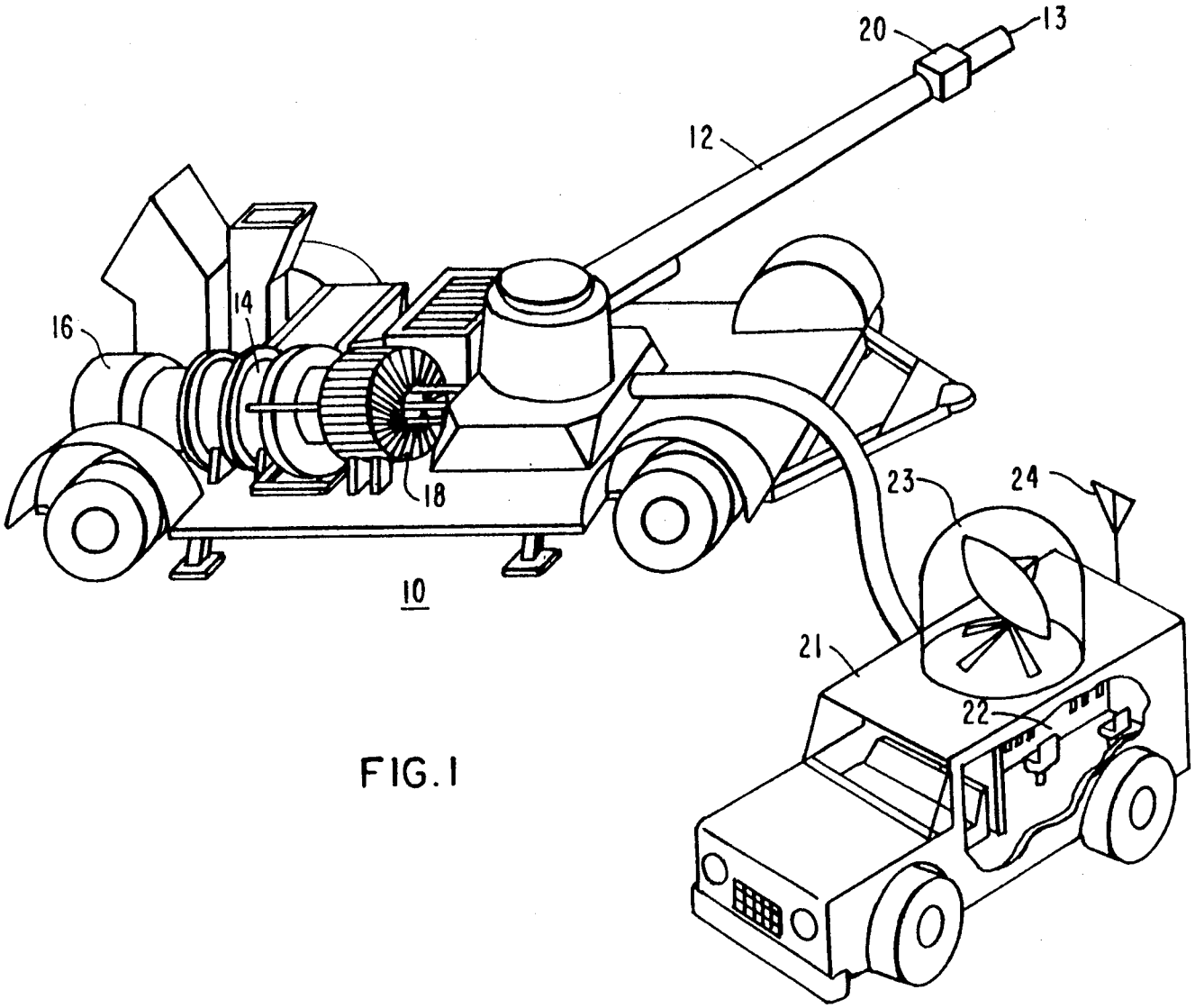
FIG. 1 illustrates an artillery piece constituted by an electromagnetic launcher system.

Referring now to FIG. 1, there is illustrated by way of example, electromagnetic launcher ordinance in the form of a field artillery piece 10 including a barrel 12 through which a projectile is electromagnetically propelled to exit the muzzle end 13 of the barrel. The apparatus includes a source of high DC current which in one embodiment may include a homopolar generator 14 driven by a prime mover such as gas turbine 16 and operated in a manner that when the homopolar generator attains a predetermined rotational speed, all, or a fraction of the kinetic energy thereof is transferred to a large inductor 18 where it is temporarily stored as electrical energy. When the inductor current magnitude reaches an appropriate firing level, the current is commutated into the rails constituting the barrel 12 to thereby launch a projectile which passes a muzzle resistance arrangement 20 and exits the muzzle end 13.

Movement of the barrel as well as firing of the projectile is governed by a fire control system 22 located within a vehicle 21 which may also carry target acquisition sensors such as radar 23 and antenna 24.

Figure 2:
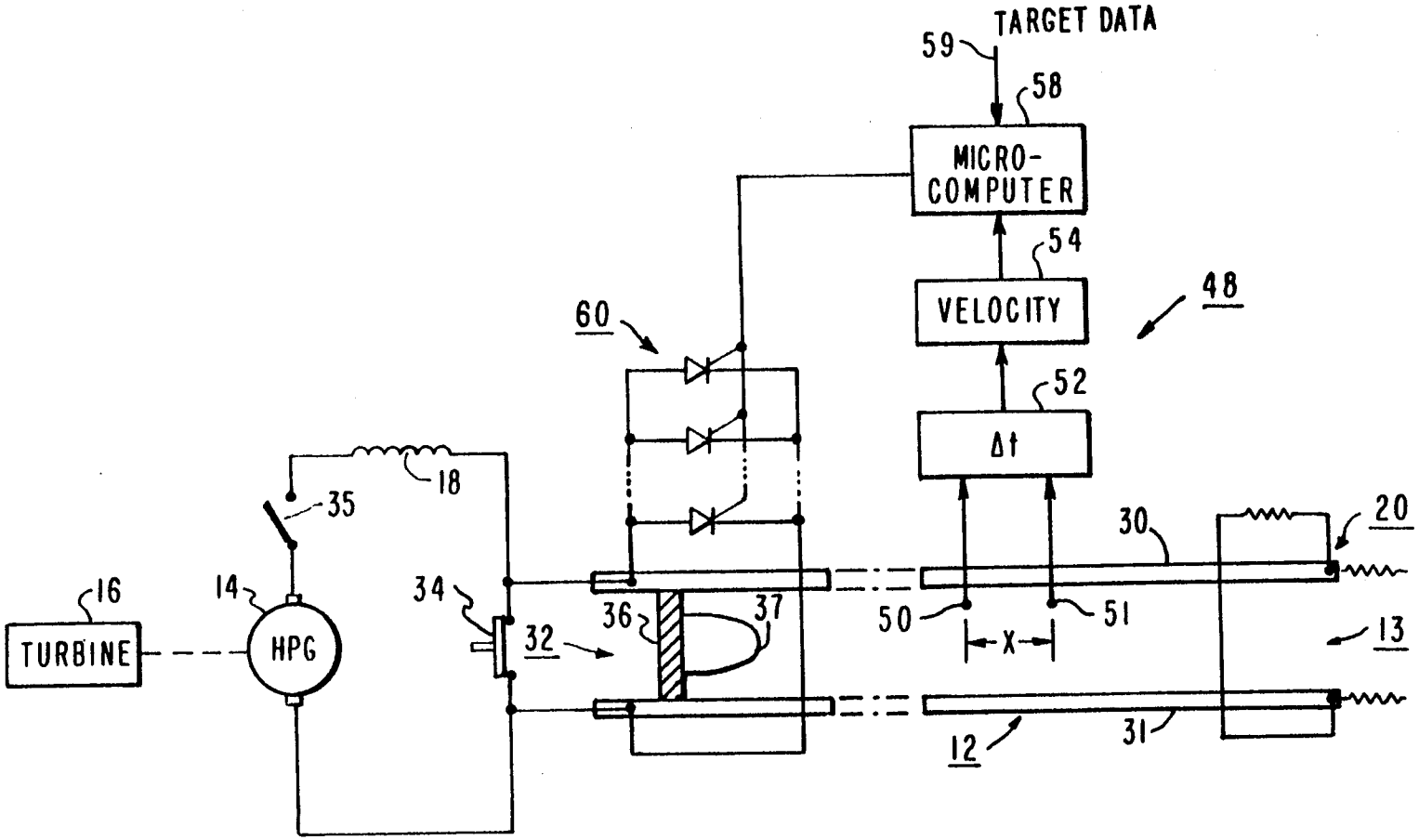
FIG. 2 illustrates a launcher system in accordance with one embodiment of the present invention.

FIG. 2 illustrates further components of a system and includes reference numerals previously described in FIG. 1. The barrel 12 is constituted by electrically conducting generally parallel rail members 30 and 31 with the breech end 32 thereof being connected to the high current source by means of a firing switch 34. Upon attainment of a predetermined rotational speed of the homopolar generator 14, switch 35 is closed and inductor 18 is charged up to a firing current level while switch 34 is maintained in a closed position. When the appropriate firing current level is attained, firing switch 34 is opened and current is commutated into rails 30 and 31 bridged by an electrically conducting armature 36 which may be of electrically conducting solid material or in some cases a plasma or arc.

Upon opening of the firing switch 34, current flows down one rail, through the armature and back along the other rail such that the current flowing in this loop causes the exertion of a force on the armature 36 to accelerate a projectile 37. The accelerating force in essence is a function of the magnetic flux density and current density vectors, and since the current flowing in the rails is often measured in millions of amperes, projectile 37 exits the muzzle end 13 of the rail system at relatively high velocities. After projectile exit from the rail system, firing switch 34 is closed and remaining inductive energy in the rails may be dissipated in the muzzle resistor arrangement 20.

In accordance with the present invention, the exit velocity of the armature 36 (and consequently of projectile 37) can be modified to a slight degree after projectile firing has been initiated.

Figure 3:
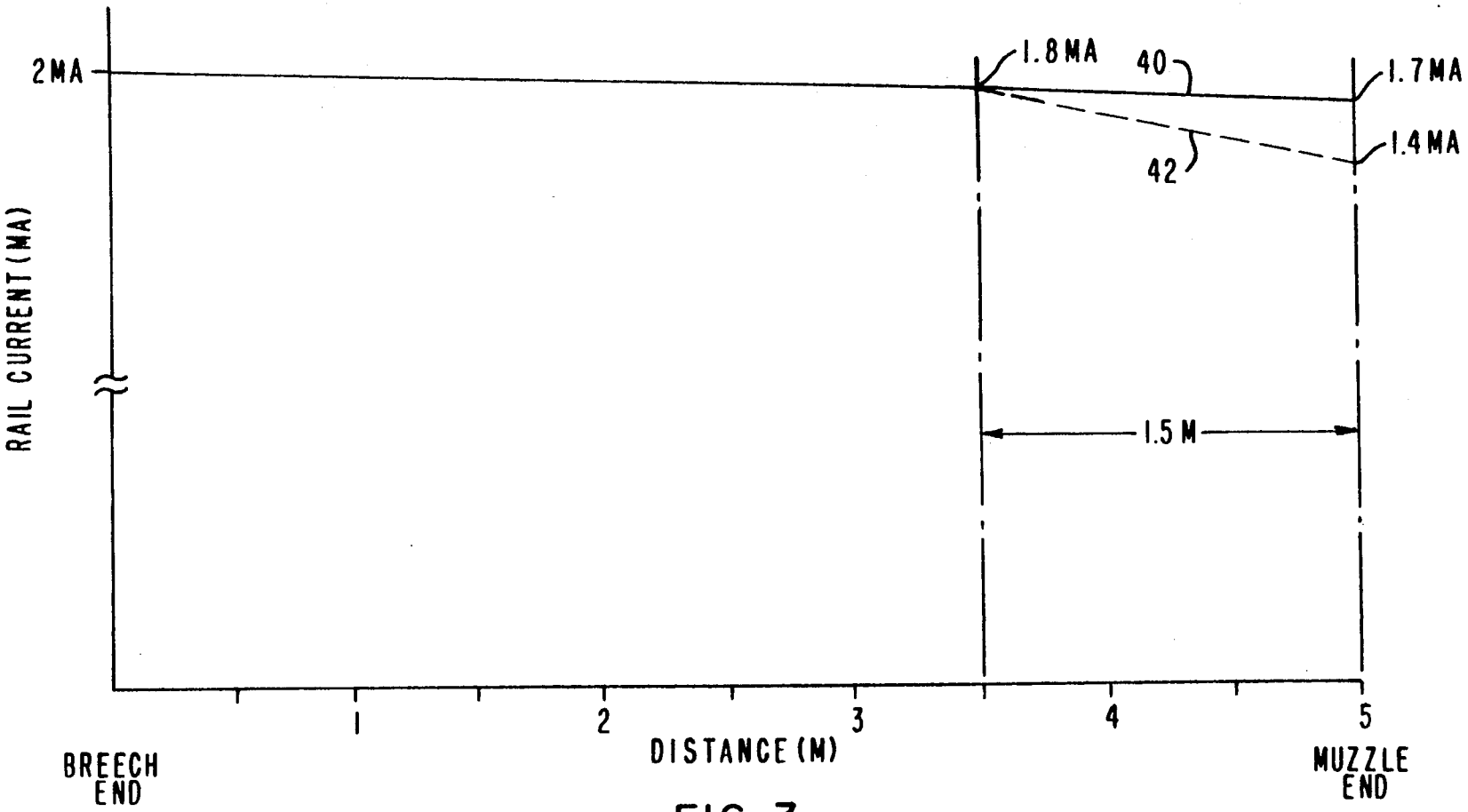
FIG. 3 is a graph illustrating rail current for two different operations of the apparatus of FIG. 2.

After firing switch 34 is opened and current is commutated into the rail system to propel the armature 36, the rail current decay can be relatively moderate due to the fact that current is being supplied by the massive energy storage of inductor 18. By way of example, and with additional reference to FIG. 3, let it be assumed that the rails 30, 31 are in the order of 5 meters long and the energy supply is such that two million amperes (MA) is the initial firing current magnitude. As indicated by curve 40 of FIG. 3, at a point 1½ meters from the muzzle end, the rail current going through the projectile propelling armature 36 is assumed to be in the order of 1.8 MA. When the armature has reached the muzzle end of the rails, the current has decayed to approximately 1.7 MA at which point firing switch 34 is closed and the inductive energy remaining in the rails is dissipated in the muzzle resistor arrangement 20.

If, however, the firing switch 34 is closed just when the armature is 1½ meters from the muzzle end, in this situation, additional accelerating energy will thereafter be supplied substantially only by the inductive rail energy storage which is of much less magnitude than that of inductor 18 and accordingly, the firing current decay will be faster as indicated for example, by dotted curve 42 such that the current just at projectile exit is reduced to 1.4 MA. In such instance, less additional kinetic energy is delivered to the projectile during the final 1½ meters of acceleration thereby resulting in a reduction in muzzle velocity such reduction being in the order of two percent. Thus, it is seen that a premature closing of firing switch 34 will produce a controlled muzzle velocity reduction.

Let it be assumed by way of example that for the proper exit velocity, the rail current is 1.4 MA at the muzzle end. In such instance, if the projectile velocity is sensed prior to the 1½ meter distance previously discussed then switch 34 could be closed when the projectile precisely reaches the 1½ meter mark so that the projectile will exit at the correct velocity. If there is a velocity deficiency, however, the switch can be closed at a later point in time or not closed at all to effect a limited velocity increase. Conversely, switch closure can be effected before the 1½ meter point to cause a velocity reduction if the sensed velocity is too high. This same scenario can be applied to a system wherein 1.7 MA is the correct current for desired exit velocity, by designing the current supply system to supply a somewhat overall greater current.

In order to accomplish the above-described operation, the present invention includes velocity measuring apparatus 48 positioned relative to the rails to obtain an indication of armature velocity (and accordingly projectile velocity) at a position upstream of the 1½ meter mark previously discussed. In FIG. 2, sensors 50 and 51, separated by a distance X, are provided to sense the passage of armature 36 to obtain a velocity indication thereof. One way of accomplishing this is to have sensors 50 and 51 provide respective output signals as armature 36 (or projectile 37) passes and to have the output of sensor 50 turn on an elapsed time counter 52 which is thereafter turned off by the output of sensor 51. Having the elapsed time and the known distance X, the velocity may be obtained by means of velocity calculation circuit 54. A microcomputer 58 is responsive to the velocity indication as well as to target indicative data, the input of which is represented by arrow 59, to compare the actual velocity with a desired velocity and calculate the precise time at which the rails 30 and 31 should be disconnected from the inductor 18 power source.

This disconnection has been described as the reclosing of firing switch 34. In actuality, firing switch 34 is a massive mechanical switch capable of handling millions of amperes of current and accordingly due to the inertia thereof is not instantaneously closable. The accuracy at which the switch 34 could be closed would be measured in terms of milliseconds, whereas microsecond accuracy is required. Accordingly, there is provided an array of controlled switching devices 60 such as ignitrons or thyristors, by way of example. Microcomputer 58 is operable in response to its inputs, to provide an output control signal to the control electrodes of the switching devices to cause precisely timed closure thereof thereby effecting a short circuit across the breech end of the rails for a period of time at least until firing switch 34 can be mechanically closed to take over the current conduction function.

Figure 4:
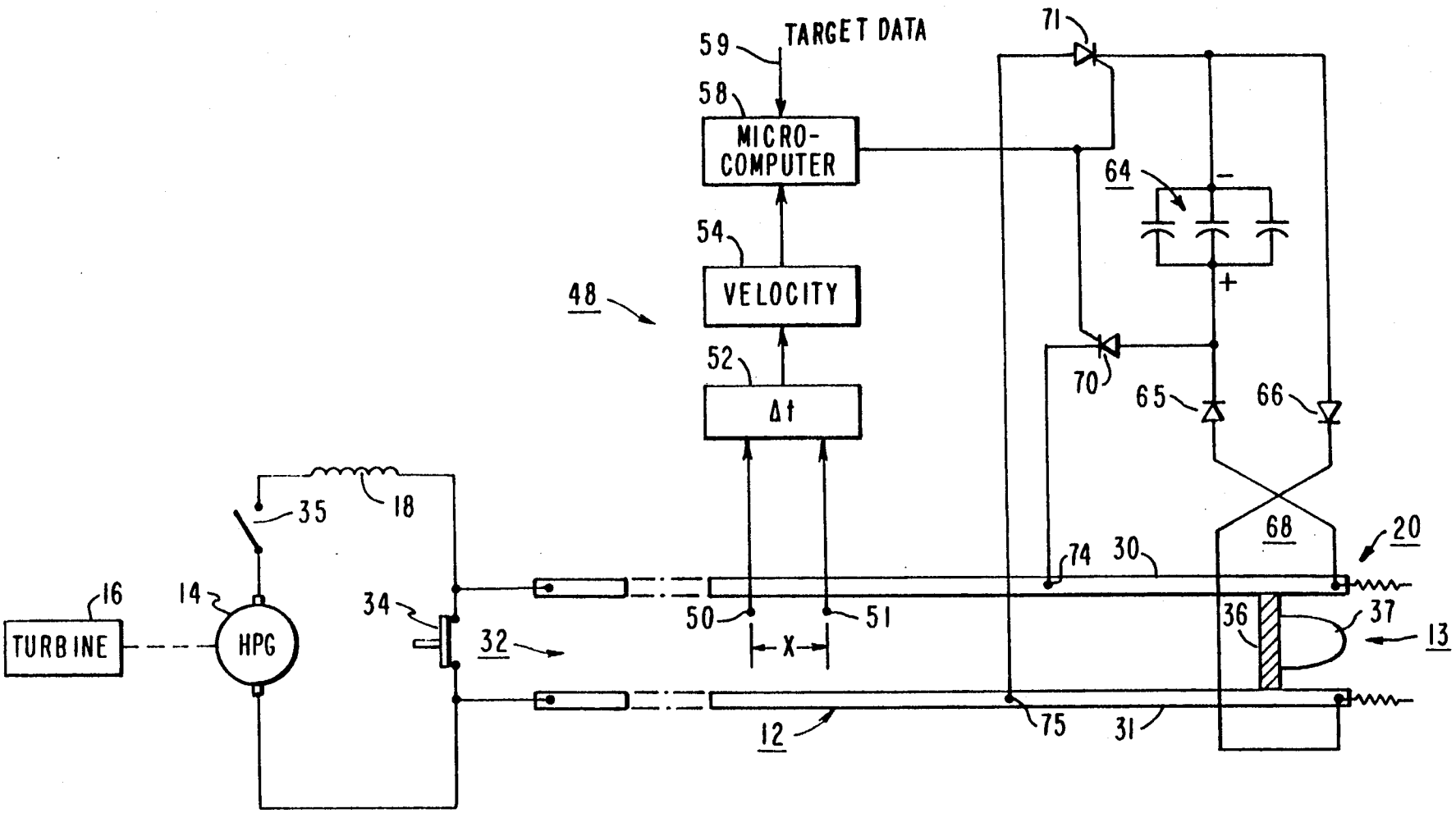
FIGS. 4 through 7 illustrate other embodiments of the present invention.
Figure 5:
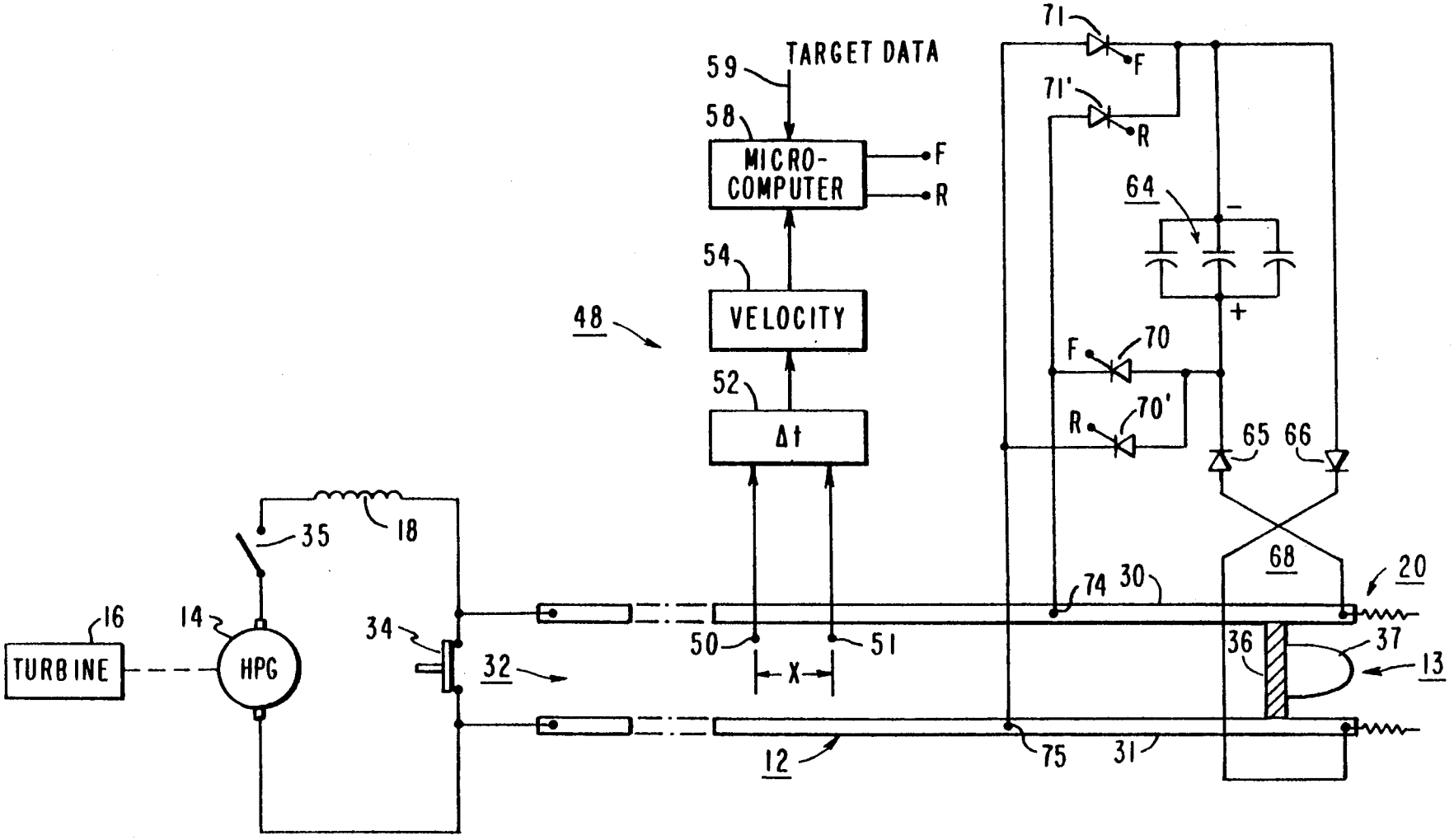

FIGS. 4 and 5 illustrate embodiments of the invention which provide a somewhat greater range of velocity adjustment than that previously described. In the embodiment of FIG. 4, post firing rail inductive energy is utilized to charge up a capacitor bank 64 via the path including unidirectional diode arrays 65 and 66 as well as low inductance cabling 68 to provide for a relatively lossless transfer. As the armature 36 exits the muzzle end 13 of the rail arrangement, and with firing switch 34 in a closed position, the inductive energy remaining in the rails is transferred to the capacitor bank 64 to be used for varying the velocity (if required) of a successively fired projectile.

If the velocity measuring means 48 indicates a projectile velocity which is too low, microcomputer 58 may then provide a control signal to turn on unidirectional controlled switching devices 70 and 71 so as to inject the energy stored in capacitor bank 64 into the rails at current injection terminals 74 and 75, as armature 36 passes their location.

A temporary reduction of the in-bore armature acceleration may be achieved by prematurely injecting current into the rails at a time prior to the arrival of armature 36 at the terminal location. Alternatively and preferably, the reduction in exit velocity may be achieved by the arrangement such as illustrated in FIG. 5.

FIG. 5 duplicates the arrangement of FIG. 4 with the addition of controlled switching devices 70' and 71' with controlled switching devices 70 and 71 being responsive to the control signal F from microcomputer 58 to cause a timely injection of current at terminals 74 and 75 to boost the acceleration while controlled switching devices 70' and 71'0 are responsive to the control signal R from microcomputer 58 to timely inject a current in the reverse direction through the armature 36 and the rails to cause a retardation of the exit velocity.

Figure 6:
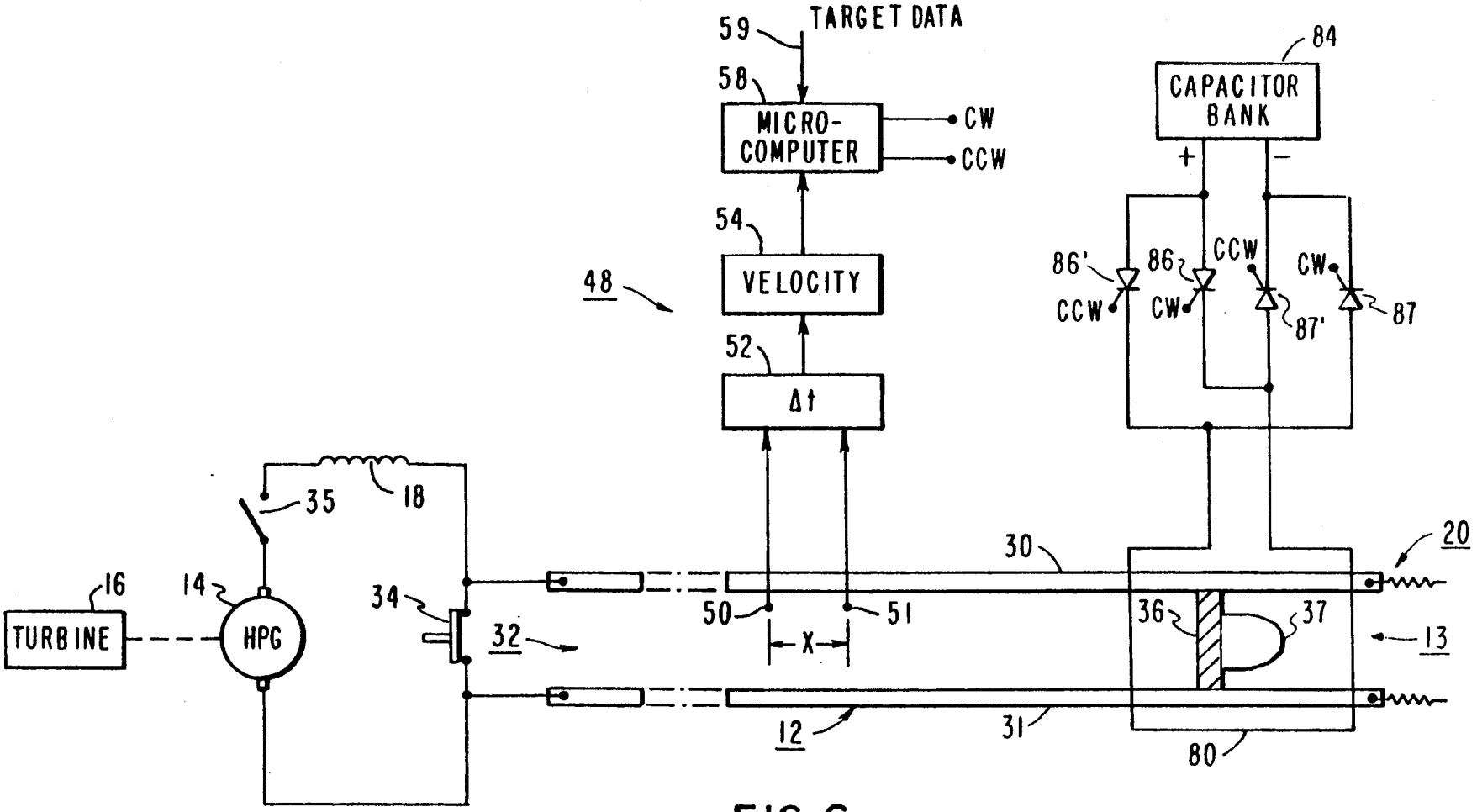

A selectively controlled velocity increase or decrease may also be accomplished by the arrangement illustrated in FIG. 6 which utilizes an external augmenting conductor loop 80 positioned adjacent the end portion of rails 30 and 31. By way of example, the conducting loop may extend over 1 meter of a 5 meter total rail length. Current for loop 80 is provided by a capacitor bank 84 which may be charged up in any well known manner for example, by an external source or by the recovery of post firing rail energy of a previous shot.

The injection of stored current from capacitor bank 84 into loop 80 is governed by a series of controlled unidirectional switching devices 86, 87 and 86', 87', the conduction of which is governed by an appropriate and timely CW or CCW control signal from the microcomputer 58. If a determination has been made that the velocity is lower than that desired, then at the appropriate time, microcomputer 58 will provide a CW signal to controlled switching devices 86 and 87 so as to discharge current in a clockwise direction within loop 80. Since the capacitor supplied current is then in the same direction as the rail current, the bore magnetic flux increases so as to add accelerating force, and therefore, velocity to the projectile. Alternatively, if a decrease in velocity is indicated, microcomputer 58 will provide the CCW signal to switching devices 86' and 87' so as to develop a counterclockwise current in loop 80 to cause a reduction in bore flux and thus a decrease in accelerating force and velocity.

Figure 7:
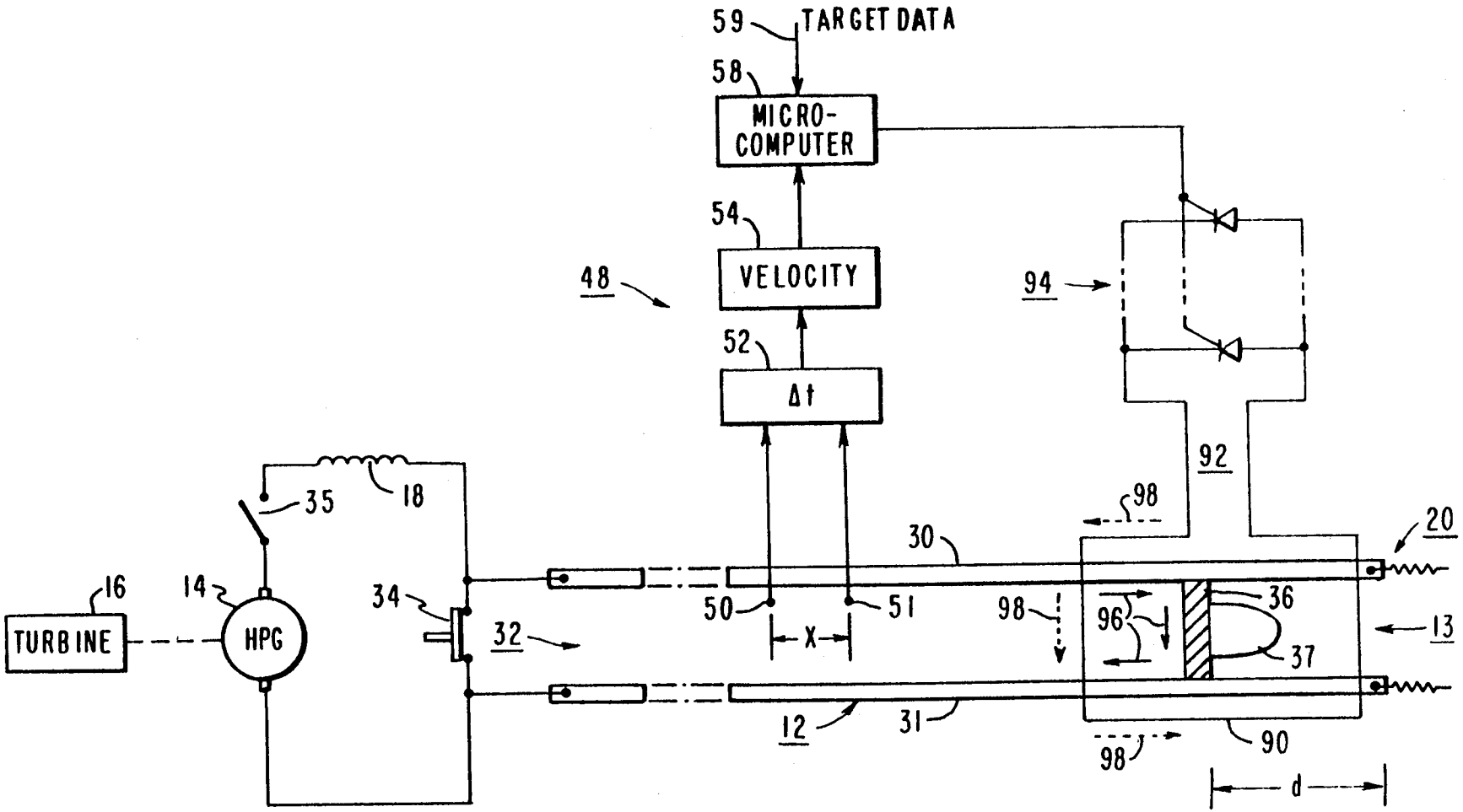

In FIG. 7, velocity adjustment is obtained with the use of a loop or winding 90 closely adjacent the rails 30 and 31. The loop is connected by means of low inductance cabling 92 to a controlled unidirectional switching device array 94, the conduction of which is governed by an appropriate control signal provided by microcomputer 58. Loop 90, located at the muzzle end of the rails, is in substantial flux linking relationship with the rail magnetic flux. While the armature 36 is accelerating and with the accelerating current direction as indicated by arrows 96, the flux linkage with loop 90 induces in that loop a voltage in accordance with the well known Lenz's law. This induced voltage is of a polarity to tend to produce current flow in the direction of the dotted arrows 98, that is opposite to the rail current direction and accordingly would tend to decrease the driving flux resulting in a reduction of armature acceleration. The induced current, however, is prevented from flowing due to the off condition of controlled switching device 94. Accordingly, by providing a proper control signal, the closing of the switching device 94 can be utilized as a means for reducing the projectile exit velocity.

In order to accommodate for both upward and downward velocity corrections, the system may operate such that when no velocity correction is required as determined by the velocity measuring means 48 and microcomputer 58, then the switching devices 94 may be given a signal to conduct when the armature is, for example, at a distance d from the end of the muzzle. With the conduction of switching devices 94, the counter current is enabled to flow in loop 90 thus effecting a lowering of exit velocity as previously discussed. Higher velocities may then be obtained by providing the signal to switching devices 94 when the armature is even closer to the muzzle or by not providing the control signal at all. A velocity reduction is achieved by a signal to the switching devices 94 at a point in time prior to the projectile arriving at the range indicated by d.

We claim:

1. An electromagnetic projectile launcher comprising:

A) a pair of generally parallel conducting rails having a breech end and a muzzle end;

B) a source of high current;

C) an armature for conducting current between said rails and for accelerating a projectile along said rails;

D) means connected to said breech end of said rails to initiate injection of said high current into said rails and armature;

E) velocity measuring means operable to obtain an indication of projectile velocity at a position between said breech and muzzle ends of said rails;

F) means for comparing said velocity indication with a predetermined desired projectile velocity;

G) armature acceleration modification means responsive to said velocity indication comparison to modify the velocity of said projectile prior to exiting said muzzle end of said rails; H) said velocity measuring means including:

i) first and second spaced apart sensors positioned proximate said rails in the direction of travel of said projectile, ii) each of said sensors being operable to provide an output signal in response to passage of said armature and projectile, iii) means responsive to said output signals of said sensors to obtain an indication of actual projectile velocity;

I) said means for comparing said projectile velocity indication with a desired projectile velocity being operable to generate at least one corrective control signal;

J) means for applying said corrective control signal top said armature acceleration modification means;

K) said armature acceleration modification means including:

i) a source of stored energy.

ii) first and second controlled switch means connecting said source of stored energy to said rails and being responsive to said control signal to cause injection of said stored energy into said rails;

L) said means for comparing being operable to selectively and timely provide a first or second control signal;

M) said first switch means being responsive to said first control signal to cause injection of said stored energy into said rails in a manner to boost projectile exit velocity;

N) said second switch means being responsive to said second control signal to cause injection of said stored energy into said rails in a manner to retard projectile exit velocity.

2. Apparatus according to claim 1 wherein:

A) said armature acceleration modification means is operable to increase the velocity of said projectile prior to said exiting.

3. Apparatus according to claim 1 wherein:

A) said armature acceleration modification means is operable to decrease the velocity of said projectile prior to said exiting.

4. Apparatus according to claim 1 wherein:

A) said source of stored energy is connected to said rails to recover post-firing inductive energy normally remaining in said rails after a projectile firing, for use in a subsequent firing.

5. Apparatus according to claim 1 wherein:

A) said rails define a portion of an artillery barrel; and which includes

B) means for obtaining information relative to a target;

C) said means for comparing is responsive to said target information for generating said predetermined desired velocity.

* * * * *